US010473080B2

(12) United States Patent
Roussel

(10) Patent No.: US 10,473,080 B2
(45) Date of Patent: Nov. 12, 2019

(54) FUNCTIONAL AIR-SUPPLY MODULE INCORPORATING AN INJECTION SET

(75) Inventor: Jerome Roussel, Colmar (FR)

(73) Assignee: SYSTEMES MOTEURS (SOCIETE PAR ACTIONS SIMPLIFIEE), Levallois, Perret (FR)

( * ) Notice: Subject to any disclaimer, the term of this patent is extended or adjusted under 35 U.S.C. 154(b) by 336 days.

(21) Appl. No.: 13/876,026

(22) PCT Filed: Sep. 26, 2011

(86) PCT No.: PCT/FR2011/052233
§ 371 (c)(1),
(2), (4) Date: Mar. 26, 2013

(87) PCT Pub. No.: WO2012/042159
PCT Pub. Date: Apr. 5, 2012

(65) Prior Publication Data

US 2013/0306030 A1 Nov. 21, 2013

(30) Foreign Application Priority Data

Sep. 29, 2010 (FR) ..... 10 57843

(51) Int. Cl.
*F02M 69/50* (2006.01)
*F02M 35/10* (2006.01)
(Continued)

(52) U.S. Cl.
CPC ..... *F02M 69/50* (2013.01); *F02M 35/10085* (2013.01); *F02M 35/10216* (2013.01);
(Continued)

(58) Field of Classification Search
USPC ..... 123/445, 456, 468, 469, 470
See application file for complete search history.

(56) References Cited

U.S. PATENT DOCUMENTS 5,163,406 A * 11/1992 Daly ..... F02M 35/10072 123/184.31
6,619,256 B2 9/2003 Morgillo et al.
(Continued)

FOREIGN PATENT DOCUMENTS

EP 1 270 917 1/2003
EP 1 240 423 3/2004
(Continued)

OTHER PUBLICATIONS

International Search Report dated Nov. 25, 2011, corresponding to PCT/FR2011/052233.

*Primary Examiner* — Lindsay M Low
*Assistant Examiner* — Ruben Picon-Feliciano
(74) *Attorney, Agent, or Firm* — Young & Thompson

(57) ABSTRACT

A functional module includes: a mounting plate (2) for fluid tight attachment to the cylinder head of an internal combustion engine, incorporating portions (3) of air tract, and an injection set provided with support and attachment legs (6') intended to rest directly on the cylinder head (7) notably at a first group of points of attachment (8) thereof. The mounting plate (2) is provided with primary attachment sites (9) intended to collaborate with a second group of points of attachment (8') of the cylinder head (7), and with secondary attachment sites (9') corresponding to at least some of the points of attachment (8) of the first group belonging to the cylinder head (7), the secondary attachment sites (9') of the mounting plate (2) being intended to be positioned over the top of at least some of the legs (6').

11 Claims, 3 Drawing Sheets

(51) Int. Cl.
*F02M 55/02* (2006.01)
*F02M 69/46* (2006.01)

(52) U.S. Cl.
CPC ..... *F02M 55/025* (2013.01); *F02M 69/465* (2013.01); *F02M 2200/803* (2013.01)

(56) References Cited

U.S. PATENT DOCUMENTS

| | | | | |
|---|---|---|---|---|
| 6,732,712 | B2 | 5/2004 | Klotz et al. | |
| 2003/0106525 | A1* | 6/2003 | Morgillo ..... | F02M 35/10085 123/336 |
| 2005/0045155 | A1* | 3/2005 | Harvey et al. ..... | 123/470 |
| 2005/0188956 | A1* | 9/2005 | Moschini et al. ..... | 123/456 |

FOREIGN PATENT DOCUMENTS

| | | |
|---|---|---|
| EP | 1 533 514 | 5/2005 |
| EP | 1 568 880 | 8/2005 |
| EP | 2 148 076 | 1/2010 |
| FR | 2 779 681 | 12/1999 |
| WO | 2011/036410 | 3/2011 |

* cited by examiner

FUNCTIONAL AIR-SUPPLY MODULE INCORPORATING AN INJECTION SET

BACKGROUND OF THE INVENTION

Field of the Invention

This invention relates to the field of equipment and accessories of internal combustion engines, more particularly those supplied by high-pressure fuel rails.

More particularly, the invention has as its object a functional air-supply module of such an engine that incorporates a fuel rail.

Description of the Related Art

In internal-combustion-engine vehicles, whose various pistons are supplied by a common fuel rail, the latter is often located close to the intake distributor or a similar supply element (compressor, . . . ) in the immediate vicinity of the engine, these two accessories having further to be rigidly attached to the engine block.

Consequently, it was obvious for a person skilled in the art to try to connect these two components or at least parts of these components to one another so that they form a structural unit having internal cohesion and can be secured together with the engine block. Various solutions in this direction have already been formulated and presented.

Thus, it has been proposed to mount the fuel rail on the distributor, for example by the document FR 2 779 681.

In this document, the two accessories are connected to one another by a quick connection. Nevertheless, an indirect attachment of the fuel rail onto the engine block through the distributor is necessarily less rigid and less strong than a direct attachment and also, in an additional manner, puts stress on at least a part of said distributor, as well as on its attachment points.

By the document WO 2011/036410, in the name of the applicant, an improved attachment mode has been proposed.

This document discloses a functional module incorporating an intake distributor with an integrated attachment and connection plate, a fuel rail, and a retention part for the locking of the rail.

In this design, the distributor participates positively in the holding of the fuel rail by the retention part and therefore has a shape and a structural strength suited to fulfilling this additional function.

It has also been proposed to attach the distributor and the fuel rail in a combined and totally interdependent way at the same attachment points, while ensuring a mechanical connection between the two elements.

Thus, the document EP 1 240 423 discloses a combined distributor-fuel rail unit, in which said rail is provided with annular extensions in the form of holding-down clamps each enclosing a pipe of the distributor. These holding-down clamps formed on the rail are equipped with support feet for the passage of attachment screws, which all line up with openings for attachment of the connection plate of the pipes and which come into contact under pressure on said plate at said openings during mounting on the engine block.

In another form of embodiment disclosed by this document, the holding-down clamps are made in one single independent piece, not having support lugs, covering the connection plate of the pipes, to close at the top the housing for receiving the rail in the plate and to attach the latter to the cylinder head under pressure to achieve airtightness.

In the two embodiments, the set of attachment points of the plate of the pipes and holding-down clamps are combined, and the latter are not in direct support on the engine block, but rest on the plate that they secure and hold flat by clamping, also using the rail, against said engine block.

For this reason, the attachment of the holding-down clamps and the attachment of the pipes are totally interdependent, and the fuel rail itself contributes to the mounting with locking of said pipes on the engine block.

Such a construction nevertheless involves a complex structure for the fuel rail when it is formed in one piece with the holding-down clamps, since the latter must engage the various portions of the pipe.

In addition, these known embodiments call for a forced configuration for the connection plate of the pipes for the purpose of achieving a total lining-up between support feet of the holding-down clamps and fastening openings of the plate of the pipes. The result can be an establishment of the attachment sites at the connection plate that is not optimized in terms of strains and stresses, especially since this plate is assembled with the intake manifold, whose positioning in the space of the main body can be offset or out-of-line relative to that of the plate.

Furthermore, stressing the fuel rail to participate positively in the securing of the plate of the pipes on the engine block generates mechanical stresses at this rail, which can be detrimental over time to its structural integrity, taking into account in particular the vibratory environment.

Finally, a necessary separation of the plate of the pipes during a separation or disassembly of the holding part may not be desirable in certain constructive configurations and may even be detrimental, for example in terms of time loss, difficulties during reassembly, and/or of airtightness.

In line with the document EP 1 240 423, the document EP 1 270 917 also presents a combined attachment solution of a plate of an intake distributor and a fuel rail, in which the rail ensures the retention and attachment of the plate.

For this reason, the fuel rail exhibits a complex structure and must be adapted to bear the resulting stresses of these additional functions of retention and attachment.

Finally, in the design proposed by the document US 2005/045155, the distributor consists of two parts, namely a lower part forming the attachment and connection plate, and an upper part forming the body of the distributor as such.

In this design, the retention of the fuel rail is performed directly and solely by the body of the distributor, the plate providing bracket supports for said rail (not direct attachment of the latter on the cylinder head). The distributor must therefore have a shape and structural strength suited to this additional function.

BRIEF SUMMARY OF THE INVENTION

This invention has in particular as its object to eliminate at least some, preferably all, of the previously mentioned drawbacks, and more particularly to provide a rigid attachment solution for the fuel rail, which does not stress the body of the distributor and which allows a certain design freedom.

For this purpose, the invention has as its object a functional module comprising, on the one hand, an attachment and connection plate that is airtight to the cylinder head of an internal combustion engine, incorporating portions of air intake pipes optionally provided with means for regulating the flow at their outlet openings, and on the other hand, a high-pressure fuel rail in the form of a pipe provided with several injectors, a functional module, characterized in that the pipe of the fuel rail is provided with support and attachment feet intended to come directly to rest on the cylinder head, particularly at the level of a first group of attachment points of the latter, and in that the plate is provided, on the one hand, with primary attachment sites intended to work with a second group of attachment points of the cylinder head and, on the other hand, secondary attachment sites corresponding to at least some of the attachment points of the first group of the cylinder head, said secondary attachment sites of the plate being intended to be positioned above at least some of the support and attachment feet of the fuel rail.

BRIEF DESCRIPTION OF THE DRAWINGS

The invention will be better understood thanks to the description below, which relates to a preferred embodiment, given by way of nonlimiting example, and explained with reference to the accompanying diagrammatic drawings, in which.

DETAILED DESCRIPTION OF THE PREFERRED EMBODIMENTS

Figure 1:
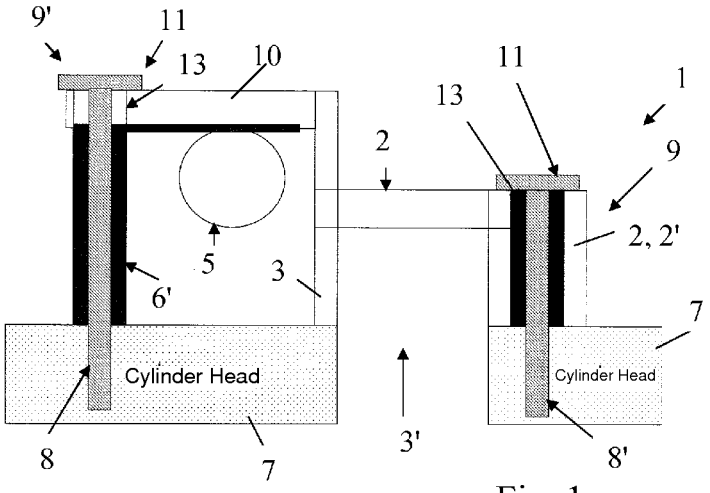
FIG. 1 is a cutaway block diagram, illustrating more particularly the attachment scheme of the functional module according to the invention.
Figure 2A:
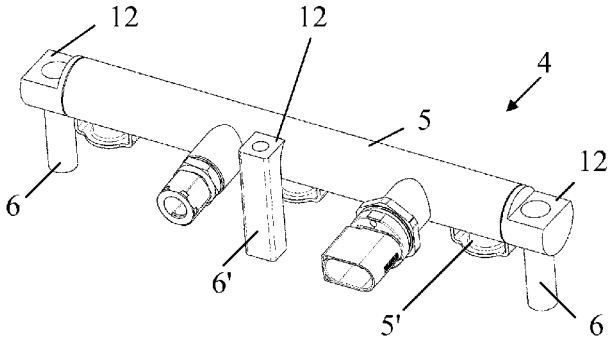
FIGS. 2A and 2B are perspective views of the two components forming the functional module, namely the fuel rail (FIG. 2A) and the attachment and connection plate (FIG. 2B), according to a practical embodiment of the invention adapted to the supplying of three cylinders.
Figure 2B:
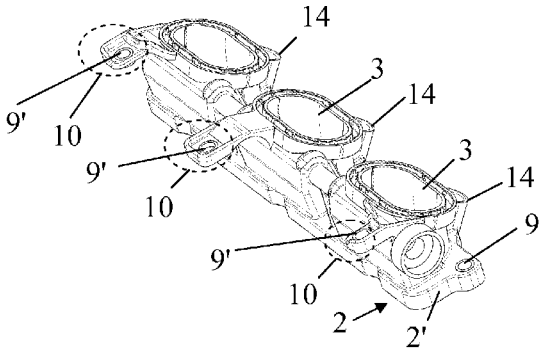
Figure 3A:
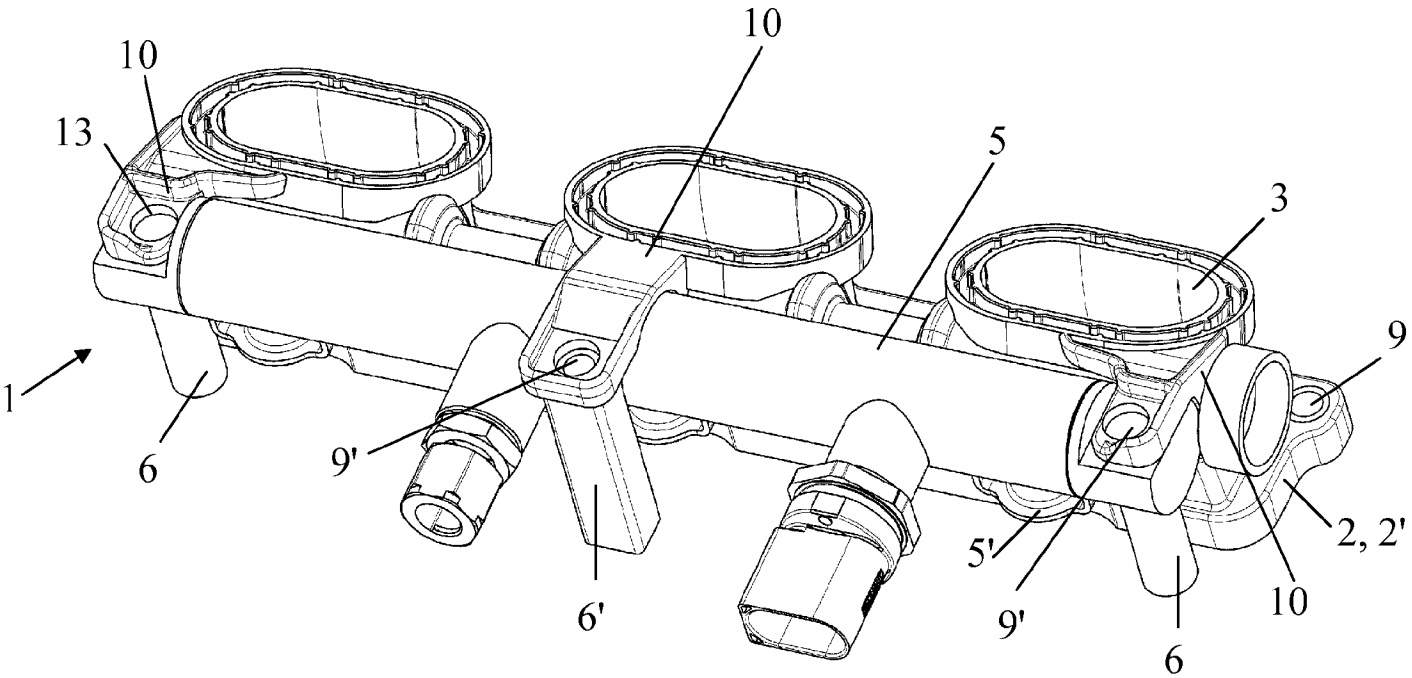
FIGS. 3A and 3B are perspective views in two different directions of the functional module after pre-assembly of the two components shown in FIGS. 2A and 2B.
Figure 3B:
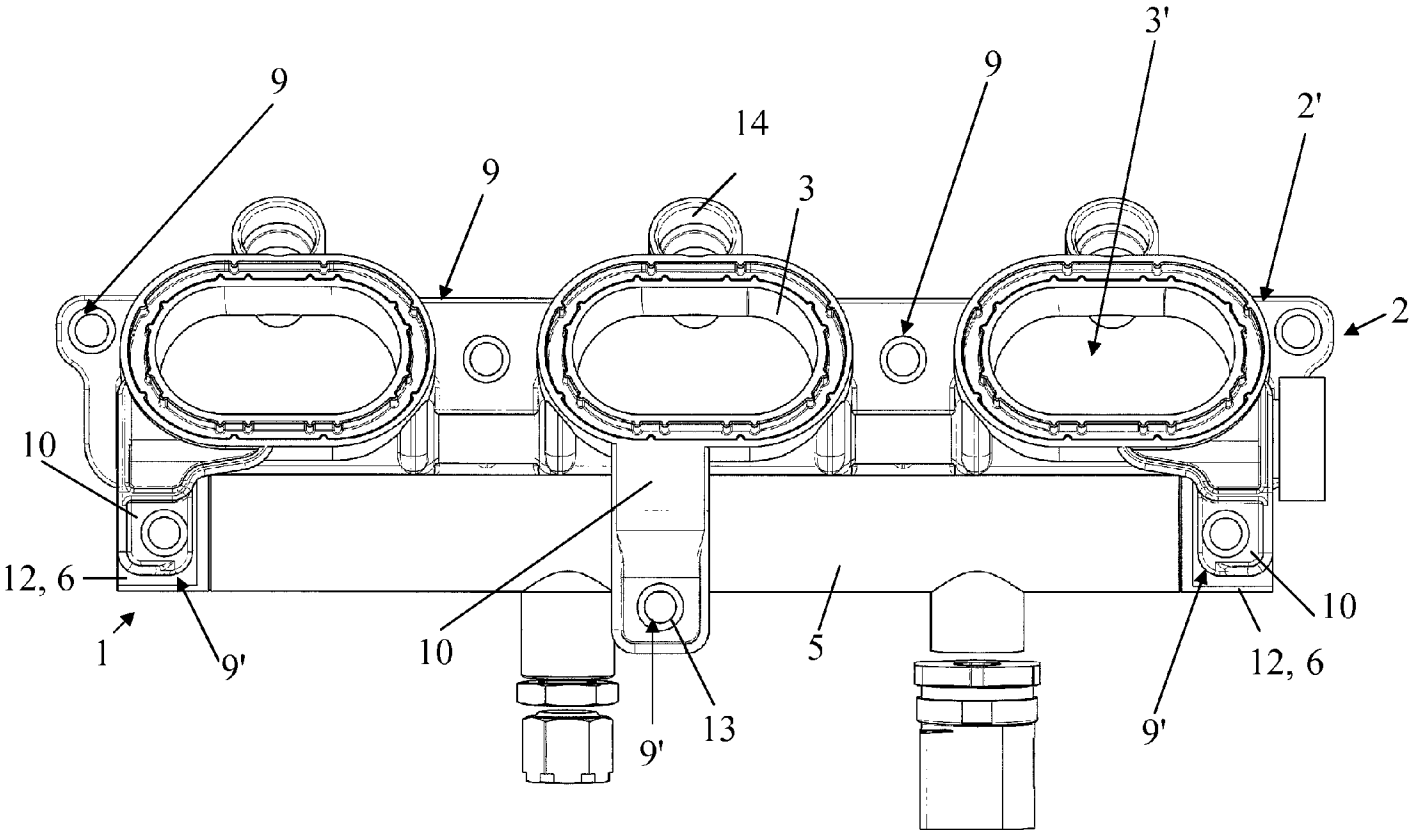

FIGS. 1 to 3 show a functional module 1 comprising, on the one hand, an attachment and connection plate 2 that is airtight to the cylinder head of an internal combustion engine, incorporating portions 3 of air intake pipes optionally provided with means for regulating the flow (for example in the form of valves) at their outlet openings 3', and on the other hand, a high-pressure fuel rail 4 in the form of a pipe 5 provided with several injectors 5'.

According to the invention, the pipe 5 of the fuel rail 4 is provided with support and attachment feet 6, 6' intended to rest directly on the cylinder head 7, particularly at a first group of attachment points 8 of the latter, and plate 2 is provided, on the one hand, with primary attachment sites 9 intended to work with a second group of attachment points 8' of the cylinder head 7, and, on the other hand, with secondary attachment sites 9' corresponding to at least some of the attachment points 8 of the first group of the cylinder head 7, said secondary attachment sites 9' of the plate 2 being intended to be positioned above at least some of the support and attachment feet 6, 6' of the fuel rail 4.

The support and attachment feet 6, 6' come to rest at least at the zones directly surrounding the attachment points 8 (generally threaded blind holes) of the first group provided on the cylinder head 7. Nevertheless, these feet 6, 6' can also optionally rest on a wider surface or in other zones offset in relation to said attachment points 8, this as a function of the shape of said feet 6, 6' of the design necessities (for example of layout) and of their embodiment (particularly their constituent material).

Thanks to the invention, the result is a direct attachment of the fuel rail 4 on the cylinder head 7, without an intermediate part and without stressing the pipe 5 for the attachment of the plate 2, nor the body of the distributor for the attachment of the pipe 5 or of the rail.

Also, the provision of specific attachment points 8' for the sole plate 2 allows a direct, rigid, and optimized attachment of the latter directly on the cylinder head 7, on which it rests, without interfering with the attachment of the fuel rail 4 and appropriate to its structure and the stresses to which it is subjected.

Although it can optionally be incorporated into the body of the distributor (one-piece distributor), the plate is preferably made in the form of a separate part onto which the body of the distributor is attached.

The differentiation of at least some of the attachment points of the rail 4, on the one hand, and of the plate 2, on the other hand, makes it possible to maintain a certain design freedom for these two elements, to select the best attachment points and sites for each of them (location, shape of the lugs, shape of the grommets or flanges, . . . ) and to decouple the operations of assembly/disassembly between these two elements.

In a complementary way, the common use of other attachment points 8' for the attachment of the rail 4 and the plate 2 makes it possible to ensure an additional securing of the latter, by using existing attachment points and without negatively interfering with the attachment of the fuel rail 4.

Finally, the provision of simple feet 6, 6' for the securing of the rail 4 makes it possible to limit the material costs and the resulting space requirement.

Advantageously, the fuel rail 4 comprises at least two support and attachment feet 6, 6' connected to or formed on the pipe 5, for example by screwing, interlocking with cooperation of shapes, welding, bonding or casting, while being mutually spaced along the latter.

Preferably, as FIGS. 2 and 3 of the accompanying drawings show, the pipe 5 of the fuel rail 4 is provided with at least three support and attachment feet 6, 6', two of which are located at or near the two opposite ends of said pipe 5.

The total number of feet 6, 6' will depend in particular on the size of the pipe 5 and on the number of attachment points 8 of the first available group on the cylinder head 7.

In conformity with a preferred embodiment of the invention, the primary attachment sites 9 are formed at the level of the panel-shaped body 2' of the plate 2 intended to come to direct and airtight rest on the cylinder head 7, and the secondary attachment sites 9' are formed at the level of the lugs or wings 10 of the plate 2 intended to extend above the support and attachment feet 6, 6' and, if necessary, the pipe 5 of the fuel rail 4.

At least one 6' of said lugs 6, 6' can optionally contribute to the retention and/or to the holding of the pipe 5, by relying on the cooperation of shapes with the latter (FIGS. 3).

According to a practical design variant of the invention, the lugs or wings 10 of the plate 2 consist of projections or protrusions of material that are formed in one piece with the walls of the portions of the pipes 3 and that extend away from the panel-shaped body 2' of said plate 2.

Although different shapes can be envisaged, it is advantageously provided, to the extent possible, that the support and attachment feet 6, 6' each exhibit a pipe-structure body through which an attachment screw 11 is intended to pass. This pipe body can comprise ends that are shaped in a particular way for resting on the cylinder head 7 and for the connection with the pipe 5.

As FIGS. 2 and 3 show, and for the purpose of optimizing the interaction between the feet 6, 6' and the lugs 10, each foot advantageously has, in its upper part, a receiving zone 12 for a wing or lug 10 of the plate 2, the secondary attachment sites 9' formed at the latter being advantageously provided with spacers 13 through which the attachment screws 11 are intended to pass. Such metal spacers 13 can also be provided in the attachment openings of the plate 2 that forms the primary attachment sites 9.

The cooperation between feet 6, 6' and lugs 10 can be provided for allowing removal by lateral disengagement of the fuel rail 4 when the attachment screws 11 (engaged in the attachment points 8 of the first group) have been removed, if necessary with a slight lateral lifting movement of the plate 2 (but without removing the screws 11 from the attachment points 8').

Preferably, the receiving zones 12 and the corresponding contact surfaces of the lugs 10 exhibit a plane shape, allowing a relative movement between them.

According to a characteristic of the invention, the attachment and connection plate 2 is made of a thermoplastic or thermosetting synthetic material, preferably by molding in one piece, and in that the fuel rail 4 is made of a metallic material, the support and attachment feet 6, 6' being made of a metallic or synthetic material.

As is evident from FIGS. 3, the module 1 can consist of a unit that is pre-assembled before on-site mounting, if necessary, with or without interlocking by temporary mutual securing of the rail 4 and the plate 2, for example by engaging or screwing.

The plate 2 can, as FIGS. 2 and 3 show, appear in the form of an independent or separate part, which is assembled after its manufacture (before or after its mounting on the cylinder head) with at least one other component of the air supply system, for example a distributor or a compressor.

As a variant, said plate 2 can constitute an integral part of a distributor (not shown), and in this case, the functional module 1 comprises said distributor provided with plate 2.

The two design variants mentioned above are part of the invention.

In the first case, because of its rigid assembly by means of multiple attachment points and with direct surface support on the cylinder head 7, the plate 2 can advantageously serve as a mounting base for other components of the air supply system of the engine.

For this purpose, the plate 2 can comprise attachment points 14 for the mounting with attaching of an intake distributor, a compressor or a similar air supply part intended to be connected in an airtight manner to the portions of pipes 3.

This invention also has as its object a vehicle with an internal combustion engine supplied by a fuel rail, characterized in that it comprises at least one functional module 1 as described above, if necessary a module 1 for each grouping of cylinders of the engine.

In particular, when the engine comprises a plurality of cylinders arranged in a V-shaped arrangement, two functional modules 1 are used, one for each alignment of cylinders.

Of course, the invention is not limited to the embodiment described and shown in the accompanying drawings. Modifications remain possible, particularly from the standpoint of the make-up of the various elements or by substitution of technical equivalents, without thereby going outside the field of protection of the invention.

The invention claimed is:

1. A fuel rail device consisting of:

two mutually-cooperating separate parts, each of which is configured to be secured to a cylinder head of an internal combustion engine, the two mutually-cooperating separate parts including a first part that is an attachment and connection plate that is airtight to the cylinder head of the internal combustion engine, incorporating portions of air intake pipes, and a second part that is a high-pressure fuel rail comprising a pipe provided with a plurality of injectors, the pipe of the fuel rail being provided with support and attachment feet configured to come directly to rest on the cylinder head at a first group of attachment points of the cylinder head, wherein the plate is provided with i) a plurality of primary attachment sites configured to cooperate with a second group of attachment points of the cylinder head to secure the plate to the cylinder head, and ii) a plurality of secondary attachment sites corresponding to at least some of the attachment points of the first group of attachment points of the cylinder head, said secondary attachment sites of the plate being configured to be positioned directly above and in axial alignment with at least some of the support and attachment feet of the fuel rail, wherein both of the primary and secondary attachment sites are secured to corresponding attachment points of the first group or the second group of the attachment points of the cylinder head by screws, one of the securing screws passing through one of the secondary attachment sites also passes through the support and attachment foot which is axially aligned and arranged in a superposed manner with the one secondary attachment site, the fuel rail comprises at least two of the support and attachment feet attached to or formed on the pipe, while being mutually spaced along the pipe, the primary attachment sites are disposed at the level of a panel-shaped body of the plate configured to come to direct and airtight rest on the cylinder head, the secondary attachment sites are disposed at the level of the lugs or wings of the plate configured to extend above the support and attachment feet, the support and attachment feet each exhibit a pipe-structure body through which the attachment screw is configured to pass, and each support and attachment foot of the fuel rail has, in an upper part thereof, a receiving portion to receive a wing or lug of the plate, the secondary attachment sites formed at the level of the plate being provided with spacers through which the attachment screws are configured to pass.

2. The fuel rail device according to claim 1, wherein the pipe of the fuel rail is provided with at least three support and attachment feet, two of the support and attachment feet being located at or near the two opposite ends of said pipe.

3. The fuel rail device according to claim 1, wherein the lugs or wings of the plate consist of projections or protrusions of material that are formed in one piece with walls of the portions of the pipes and that extend away from the panel-shaped body of said plate.

4. The fuel rail device according to claim 1, wherein the attachment and connection plate is made of a thermoplastic or thermosetting synthetic material, and wherein the fuel rail is made of a metallic material, the support and attachment feet being made of a metallic or synthetic material.

5. The fuel rail device according to claim 1, further comprising a unit that is pre-assembled before on-site mounting with or without interlocking by temporary mutual securing of the rail and the plate.

6. The fuel rail apparatus according to claim 1, wherein the attachment and connection plate comprises attachment points for mounting with securing of an intake distributor, a compressor or an air supply part configured to be connected in an airtight manner to the portions of the pipes.

7. A vehicle with an internal combustion engine supplied by a fuel rail, comprising:

at least one fuel rail device according to claim 1.

8. The fuel rail device according to claim 1, wherein the air intake pipes are provided with a regulation device configured to regulate the flow at outlet openings of the air intake pipes.

9. The fuel rail device according to claim 1, wherein the support and attachment feet are attached to or formed on the pipe by screwing, interlocking with cooperation of shapes, welding, bonding, or casting.

10. The fuel rail device according to claim 1, wherein the secondary attachment sites disposed at the level of the lugs or wings of the plate are configured to additionally extend above the pipe of the fuel rail.

11. A fuel rail device consisting of:

two mutually-cooperating separate parts, each of which is configured to be secured to a cylinder head of an internal combustion engine, the two mutually-cooperating separate parts including a first part that is an attachment and connection plate that is airtight to the cylinder head of the internal combustion engine, incorporating portions of air intake pipes, and a second part that is a high-pressure fuel rail comprising a pipe provided with a plurality of injectors, the pipe of the fuel rail being provided with support and attachment feet configured to come directly to rest on the cylinder head at a first group of attachment points of the cylinder head, wherein the plate is provided with i) a plurality of primary attachment sites configured to cooperate with a second group of attachment points of the cylinder head to secure the plate of the cylinder head, and ii) a plurality of secondary attachment sites corresponding to at least some of the attachment points of the first group of attachment points of the cylinder head, said secondary attachment sites of the plate being configured to be positioned directly above and in axial alignment with at least some of the support and attachment feet of the fuel rail, the secondary attachment sites being formed in a plurality of lugs or wings consisting of projections or protrusions of material that are made in one piece with walls of the portions of the pipes and that extend away from a panel-shaped body of the plate, wherein both of the primary and secondary attachment sites are secured to corresponding attachment points of the first group or the second group of the attachment points of the cylinder head by screws, one of the securing screws passing through the secondary attachment site also passes through the support and attachment foot which is axially aligned and arranged in a superposed manner with the secondary attachment site, the fuel rail comprises at least two of the support and attachment feet attached to or formed on the pipe, while being mutually spaced along the pipe, the primary attachment sites are disposed at the level of a panel-shaped body of the plate configured to come to direct and airtight rest on the cylinder head, the secondary attachment sites are disposed at the level of the lugs or wings of the plate configured to extend above the support and attachment feet, the support and attachment feet each exhibit a pipe-structure body through which the attachment screw is configured to pass, and each support and attachment foot of the fuel rail has, in an upper part thereof, a receiving portion to receive a wing or lug of the plate, the secondary attachment sites formed at the level of the plate being provided with spacers through which the attachment screws are configured to pass.

* * * * *